US009457877B2

(12) United States Patent
Chung

(10) Patent No.: US 9,457,877 B2
(45) Date of Patent: Oct. 4, 2016

(54) FIN SYSTEM FOR WATERCRAFT

(71) Applicant: John Hoon Chung, Beverly Hills, CA (US)

(72) Inventor: John Hoon Chung, Beverly Hills, CA (US)

( * ) Notice: Subject to any disclaimer, the term of this patent is extended or adjusted under 35 U.S.C. 154(b) by 0 days.

(21) Appl. No.: 14/756,299

(22) Filed: Aug. 24, 2015

(65) Prior Publication Data

US 2016/0052608 A1 Feb. 25, 2016

Related U.S. Application Data

(60) Provisional application No. 62/041,128, filed on Aug. 24, 2014.

(51) Int. Cl.
*B63B 1/00* (2006.01)
*B63B 35/00* (2006.01)
*B63B 35/79* (2006.01)

(52) U.S. Cl.
CPC ..... *B63B 35/7926* (2013.01); *B63B 35/793* (2013.01)

(58) Field of Classification Search
CPC ..... B63B 35/79; B63B 35/7926; B63B 2035/79; B63B 2035/813
USPC ..... 441/65, 74, 79
See application file for complete search history.

(56) References Cited

U.S. PATENT DOCUMENTS

2004/0248482 A1* 12/2004 Larkin ..... B63B 35/7926 441/79
2005/0075017 A1* 4/2005 Bistline ..... B63B 35/793 441/74
2006/0258239 A1* 11/2006 Field ..... B63B 35/793 441/79
2007/0202760 A1* 8/2007 Caldwell ..... B63B 35/793 441/79
2007/0218788 A1* 9/2007 Field ..... B63B 35/793 441/79
2012/0028532 A1* 2/2012 Thompson ..... A63H 3/003 446/73
2012/0100767 A1* 4/2012 McCredie ..... B63B 35/793 441/79
2012/0279436 A1* 11/2012 Wood ..... B63B 35/793 114/343
2013/0071178 A1* 3/2013 Bradley ..... B63B 35/793 403/270

* cited by examiner

*Primary Examiner* — Daniel V Venne

(57) ABSTRACT

An improved fin system for surfboards and other watercraft that utilizes a series of wide, flanged, fin boxes as a means of securing the fins into the base of the surfboard body. The fin boxes create a cantilever effect that provides additional strength and rigidity to the fins when compared to other available systems. Additionally, each fin tab of a fin can be installed into a self-contained fin box, thereby allowing for separation of the fin boxes once installed. The separation between the fin boxes permits increased longitudinal and torsional flex of the watercraft body when compared to a unitary fin box design.

8 Claims, 9 Drawing Sheets

FIN SYSTEM FOR WATERCRAFT

CROSS REFERENCE TO RELATED APPLICATIONS

This application claims priority to the related U.S. provisional application No. 62/041,128 filed on Aug. 24, 2014.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not applicable.

STATEMENT REGARDING PRIOR DISCLOSURES BY THE INVENTOR OR A JOINT INVENTOR

Any disclosures by the inventor regarding the claimed invention were made within a year or less prior to the effective filing date of this application.

FIELD OF THE INVENTION

The claimed invention relates to fin systems for surfboards and other watercraft.

BACKGROUND OF THE INVENTION

Conventionally, removable fin systems were developed to allow users to replace fins when broken, experiment with different types of fins, and provide ease in transporting the watercraft when the fins where removed. However, conventional removable fin systems often create rigidity through the tail of the watercraft that impede longitudinal and torsional flex, while at the same time weakening the overall structure by creating shear points in the board. Furthermore, the fins themselves can become loose over time and cause water leakage due to poor adherence of the fin box to the body of the board. Accordingly, the need exists for alternative approaches that effectively provide flex and strength. The present invention is directed to an improved fin system that provides increased strength of mechanical bond between the fin and board while enhancing the flexibility of the watercraft body.

BRIEF SUMMARY OF THE INVENTION

Embodiments disclosed herein are directed to an improved fin system for surfboards and other watercraft that utilizes a series of wide, flanged, fin boxes as a means of securing the fins into the base of the surfboard body.

When a surfboard is in use, the greatest forces encountered by the fins are tangential to their orientation. This is due to the lift from their foil and the user pushing against the fins laterally during turns. A preferred embodiment is comprised of elongated, flanged, fin boxes that extend in a perpendicular direction away from the length of the fin base. When fins are installed into the fin boxes, the fin boxes extend away from the base of the fins creating a cantilever that provides increased stability to better oppose the tangential forces against the fins. Each fin box utilizes a footing that extends in one direction underneath the flange to create the cantilever effect. The cantilever foot provides a wider footprint that spreads out the load when the fin is faced with lateral forces. The majority of existing fin box systems are narrow and installed longitudinally, parallel to the fin's orientation, running in the direction of the length of the board. These existing systems not only impede flex, they provide little strength against lateral forces and can become loose and allow water seepage into the core material of the watercraft over time.

In one embodiment, each fin box contains a elongate slot that accepts a correspondingly shaped fin tab. Each fin has two fin tabs extending downward off the base of the fin requiring two independent fin boxes to accept each fin tab. This embodiment allows for separation and spacing between the fin boxes that secure an individual fin. By allowing for spacing between the fin boxes, the posterior end of the surfboard can flex more freely. Other existing systems with unitary or long channel style fin boxes impede flex and create stiff spots in the length of the board where the fin boxes are installed. In multiple finned boards, the gaps between these longitudinally installed fin boxes create shear points in the board that can be prone to breakage. The present embodiments allow for a more uniform flex throughout the fin area which dissipates the stress by bending more evenly.

In one embodiment, the cantilever foot is surrounded by a thin, flexible sidewall that can move and flex with the soft foam core of a surfboard once installed. The bond between hard or stiff materials that are glued or fixed to a softer material like foam can often fail. By utilizing a thin flexible wall around the cantilever footing of the fin box, it allows both materials to flex together in a similar fashion, thus ensuring the bond between the wall and foam remains intact.

In another embodiment, a fin box contains two cantilever feet extending in opposing directions underneath the flange. The dual cantilever design provides additional strength and support for the fin when desired. This fin box can be installed in any location that allows for space on both sides of the fin for the dual cantilever. In one embodiment, the dual cantilever fin boxes secure the rear center fin, but could be utilized at multiple locations depending on the desired quantity and arrangement of fins.

In another embodiment the fin boxes may be variably spaced for controlling the flex of the installed fin. For example, a fin may be designed with the fin tabs extending down from the fin closer together and forward toward the leading edge of the fin. This configuration would leave the posterior portion of the fin to flex laterally since that area of the fin is not supported by the anchoring effect of any fin tabs and corresponding fin boxes. In contrast, the fin tabs may be spaced farther out to the leading and trailing edge of the fin to make the fin stiffer laterally.

These and other aspects of the invention will be better appreciated and understood when considered in conjunction with the following description and the accompanying drawings. The following description, while indicating various embodiments of the embodiments and numerous specific details thereof, is given by way of illustration and not of limitation. Many substitutions, modifications, additions or rearrangements may be made within the scope of the embodiments, and the embodiments includes all such substitutions, modifications, additions or rearrangements.

BRIEF DESCRIPTION OF THE SEVERAL VIEWS OF THE DRAWINGS

Non-limiting and non-exhaustive embodiments of the present embodiments are described with reference to the following FIGURES, wherein like reference numerals refer to like parts throughout the various views unless otherwise specified.

Figure 1:
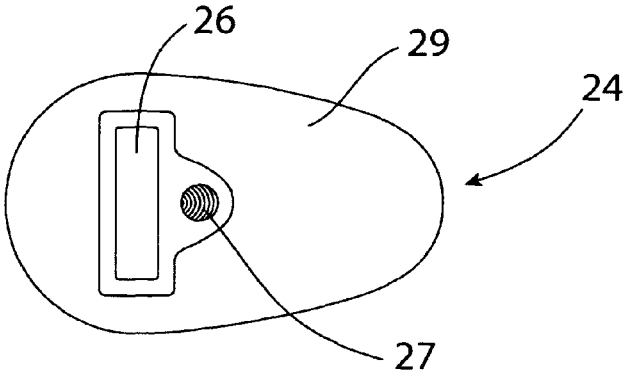
FIG. 1 is a top plan view of an individual fin box, in accordance with one or more implementations.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help to improve understanding of various embodiments. Also, common but well-understood elements that are useful or necessary in a commercially feasible embodiment are often not depicted in order to facilitate a less obstructed view of these various embodiments.

DETAILED DESCRIPTION OF THE INVENTION

In the illustrated embodiments of the invention, a fin attachment system for watercraft is disclosed. Referring initially to FIG. 1, a preferred embodiment for fin box 24 is shown. The fin box 24 is adapted for the insertion and releasable attachment of a fin 23 to the underside of a watercraft body 22. Watercraft is a general term that includes surfboards, paddle boards, or any other watercraft that utilizes fins. Fin box 24 is comprised of a body made of injection molded plastic or other suitable material. In one embodiment, the fin box has a top portion comprised of the opening of elongate slot 26, a threaded hole 27, and a peripheral flange 29, and a bottom portion comprised of cantilever foot 31 and the closed lower base portion of the elongate slot 26. In yet another embodiment, a flexible side wall 30 surrounds cantilever foot 31 and the closed lower base portion of elongate slot 26, best seen in FIG. 5.

Figure 12:
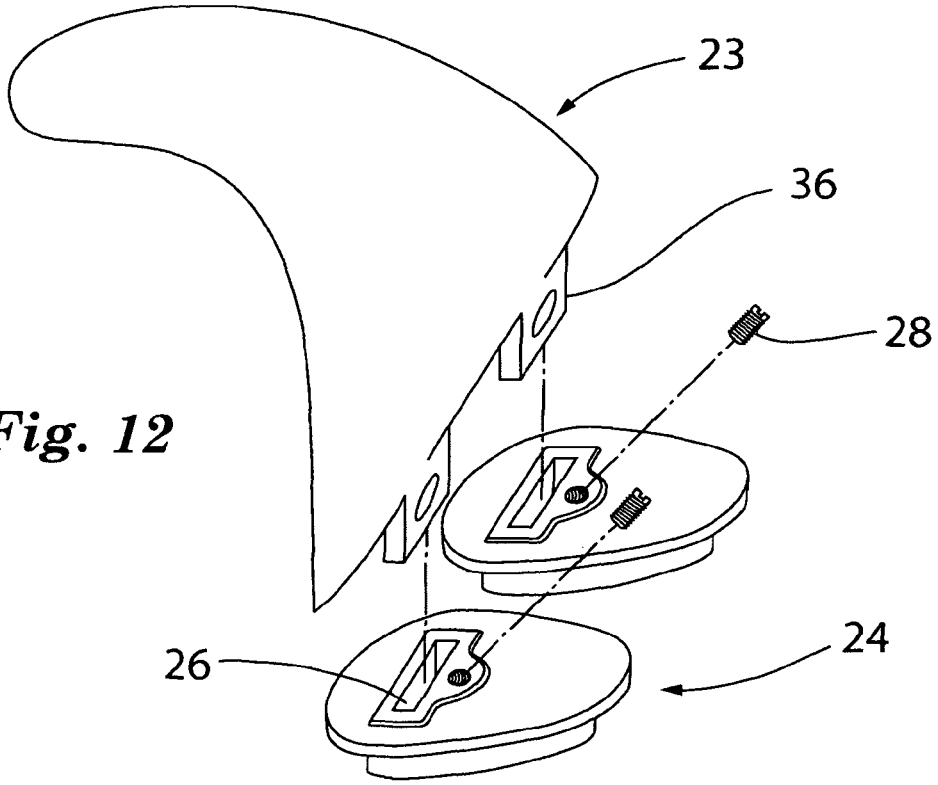
FIG. 12 is a perspective view of a fin and two corresponding fin boxes, in accordance with one or more implementations.
Figure 13:
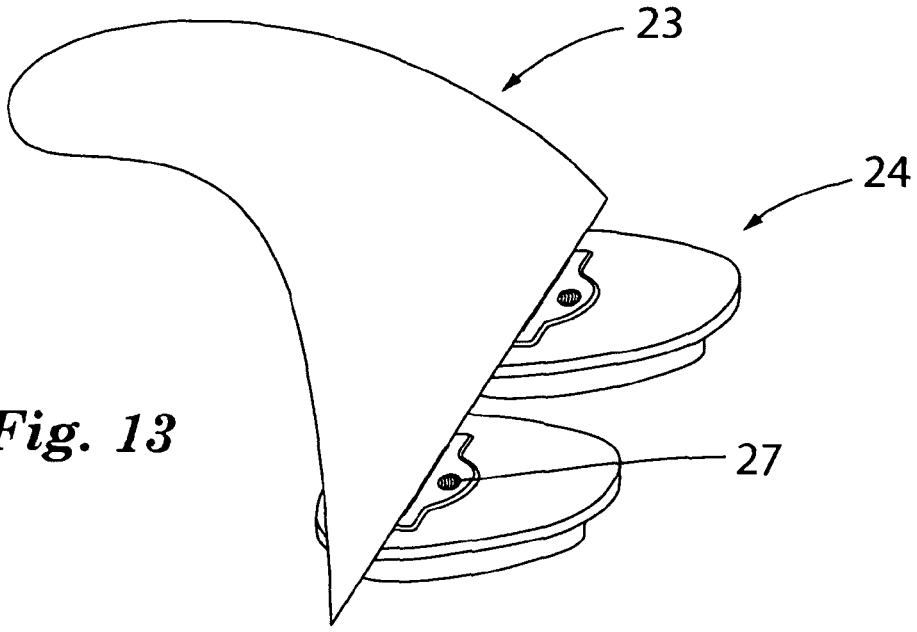
FIG. 13 is a perspective view of a fin when inserted into two corresponding fin boxes, in accordance with one or more implementations.

Elongate slot 26 is open at the top surface of the peripheral flange 29, and extends down vertically to a closed base, terminating at the bottom surface of the fin box itself. The opening of elongate slot 26 is oriented lengthwise, running in the general direction of the length of the watercraft body when installed, and perpendicular to the fin box width. The elongate slot 26 is formed to receive a complementary shaped fin tab 36 that extends down from the base of a fin 23 as seen in FIG. 12. In this embodiment, the fin has two fin tabs which are inserted into the elongate slots of two corresponding fin boxes. Other embodiments may have only one fin tab, or more than two. The number of fin tabs per fin will depend on the length of the fin's base as well as the size of the fin to provide sufficient support to resist strain against the fin.

Figure 3:
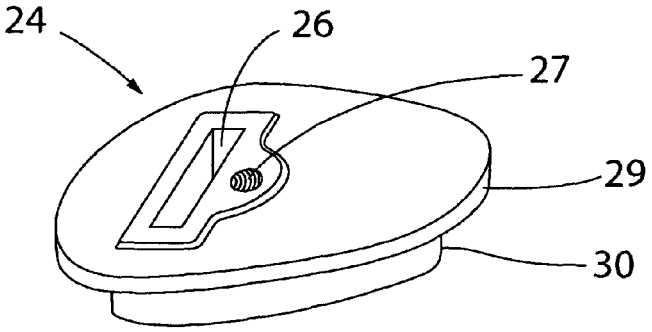
FIG. 3 is a perspective view of the fin box in FIG. 1 from the surface side, in accordance with one or more implementations.
Figure 4:
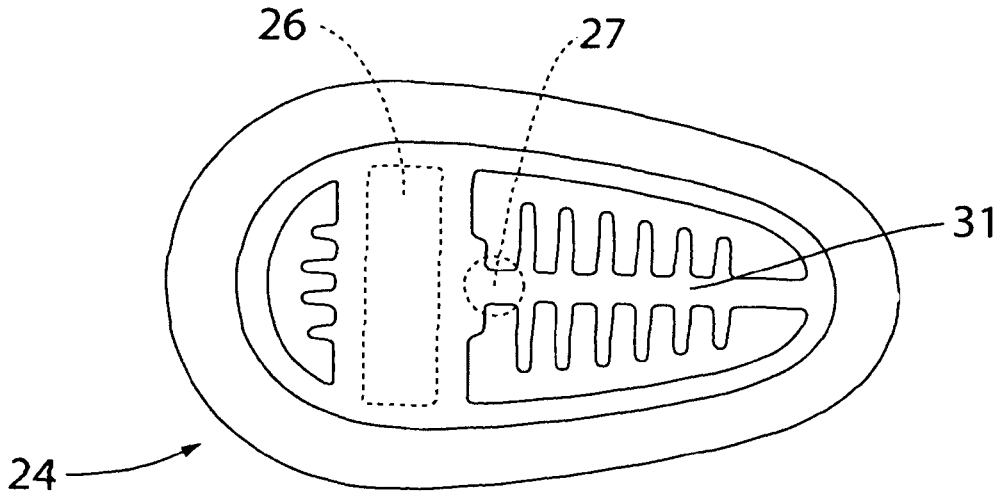
FIG. 4 is a bottom plan view of the fin box in FIG. 1, in accordance with one or more implementations.

Peripheral flange 29 surrounds the top open portion of elongate slot 26 and extends away from the open portion at a level slightly below the slot and threaded hole 27 as seen in FIG. 3. The peripheral flange provides the width and support to the fin box, as well as an additional surface to adhere to the core material 33. In one embodiment, a thin flexible side wall 30 extends downward from the underside of the peripheral flange 29. When the fin box is installed, the flexible side wall allows for better adherence to the core material 33 of the watercraft body, which is most often foam or other soft buoyant material. Harder materials fixed to foam tend to fail at the glue line. By using a thinner flexible side wall for the bottom portion of the fin box, there is no need for a high density foam intermediary bonding surface. The side wall will remain fixed directly to the core material as it can flex and move with the core material when the board is in use.

Figure 2:
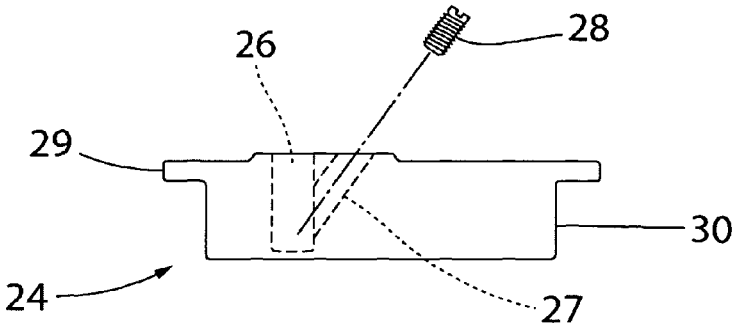
FIG. 2 is an elevation view of the fin box in FIG. 1, in accordance with one or more implementations.
Figure 6:
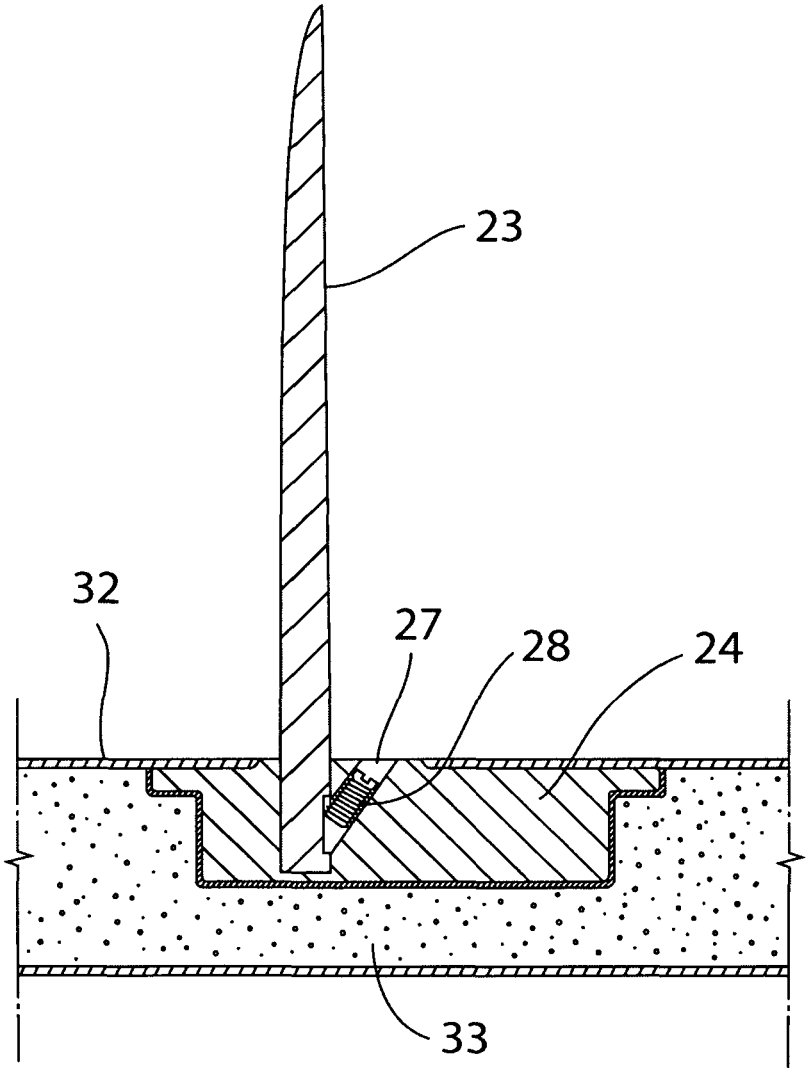
FIG. 6 is a cross-sectional view of a fin engaged in a fin box mounted in a watercraft body, in accordance with one or more implementations.
Figure 7:
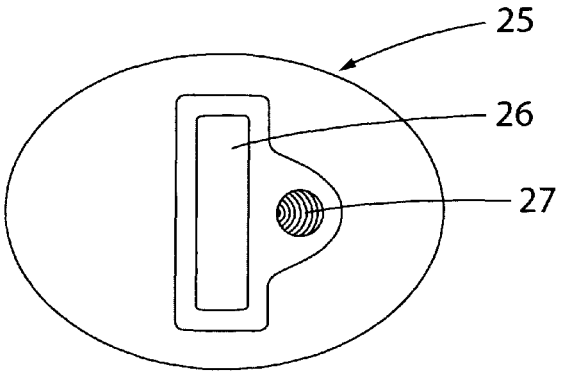
FIG. 7 is a top plan view of dual cantilever fin box, in accordance with one or more implementations.
Figure 8:
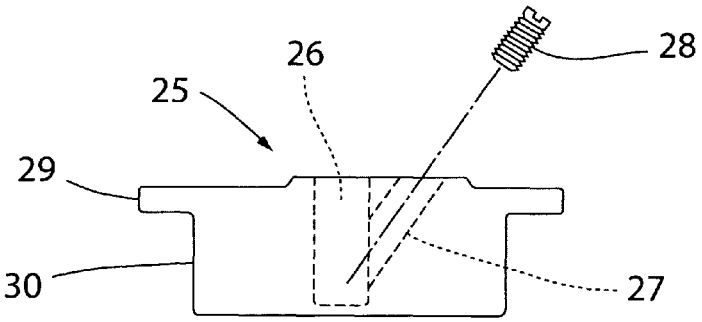
FIG. 8 is an elevation view of the dual cantilever fin box in FIG. 7, in accordance with one or more implementations.
Figure 9:
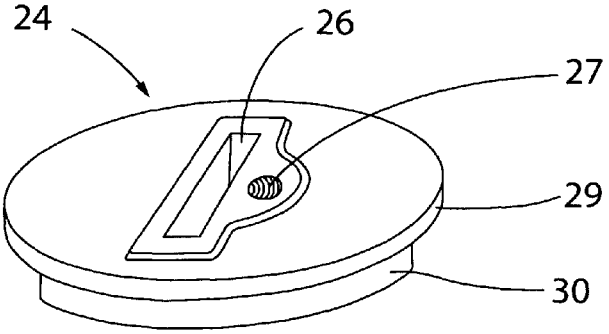
FIG. 9 is a perspective view of the dual cantilever fin box in FIG. 7 from the surface side, in accordance with one or more implementations.
Figure 10:
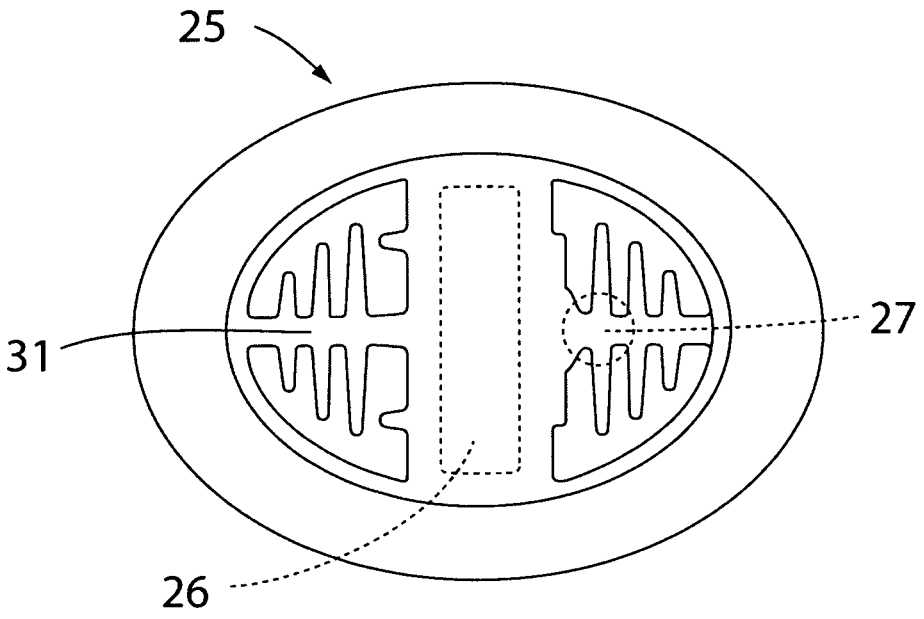
FIG. 10 is a bottom plan view of the dual cantilever fin box in FIG. 7, in accordance with one or more implementations.

Referring to FIG. 2, the threaded hole 27 begins on the upper surface of peripheral flange 29 next to the elongate slot 26 and extends downward at an angle terminating through one lateral wall on the interior of the elongate slot 26. When ready to mount a fin to the surfboard, a grub screw 28 is threaded downward into the threaded hole 27 until it contacts the fin tab of fin 23, as seen in FIG. 6. When tightened, the grub screw holds the fin securely in the fin box by creating pressure between the fin tab and the inside wall of the elongate slot. The elongate slot can be manufactured with varying degrees of cant to make the fin stand at the desired angle to the bottom surface of the watercraft.

Figure 5:
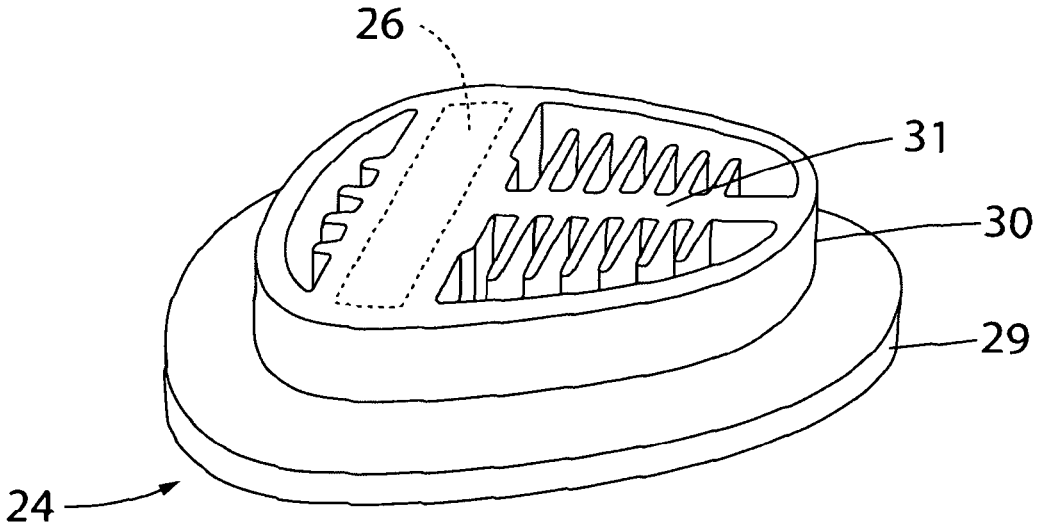
FIG. 5 is a perspective view of the fin box in FIG. 1 from the bottom side, in accordance with one or more implementations.

A view of the bottom surface of fin box 24 is best shown in FIG. 5. In this embodiment, the flexible side wall 30 emanates from the lower surface of the peripheral flange 29 creating a thin flexible barrier around the closed lower portion of the elongate slot 26 and primary cantilever foot 31. Primary cantilever foot 31 is comprised of a main body and a plurality of arms. The main body extends perpendicular to the orientation of the opening of elongate slot 26, running from one external side of the closed lower portion of elongate slot 26 to an interior portion of the flexible side wall 30. A plurality of arms extend off from both sides of the main body of the cantilever foot at varying lengths. The primary cantilever foot emanates vertically from the lower surface of the peripheral flange, terminating to form the bottom surface of the fin box. In one embodiment, the bottom surface of the fin box is defined by the base of the lower portion of elongate slot 26, the base of the primary cantilever foot 31, and the base of flexible side wall 30, as seen in FIG. 5.

The width of the cantilever foot provides added strength and rigidity to the fin box by increasing the footprint which opposes the lateral forces placed on the fin when the surfboard user make turns or when the fins are impacted by an object. Fin systems with narrow footprints composed of plugs or channels, permit more lateral movement of the fins when they are mounted in the softer foam core material. The wider footprint provided by the cantilever foot and plurality of arms spreads out the load and allows for less lateral movement of the fins.

Figure 11:
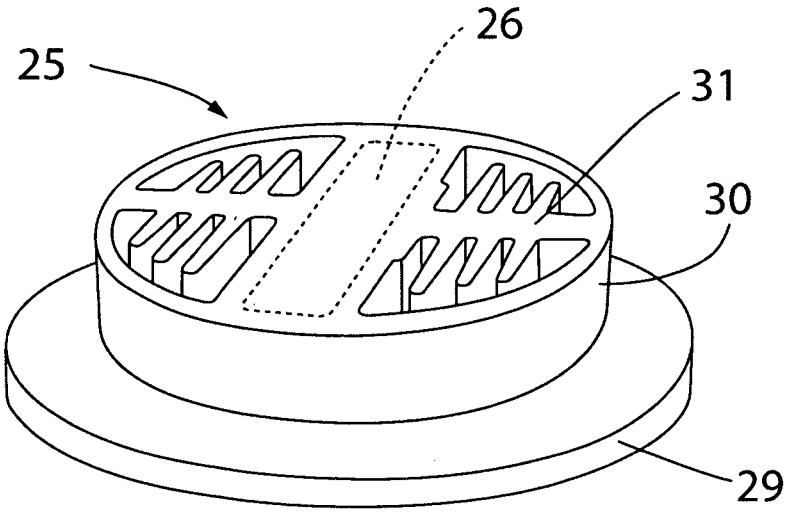
FIG. 11 is a perspective view of the dual cantilever fin box from FIG. 7 from the bottom side, in accordance with one or more implementations.

In another embodiment, FIG. 11 best illustrates a fin box 25 comprised of a dual cantilever foot 31 with a primary and secondary foot. Fin box 25 is comprised of the same elements as fin box 24, with two notable differences. First, the elongate slot 26 is located closer to the center of peripheral flange 29, instead of slightly askew as in fin box 24. Secondly, on the bottom portion of fin box 25, there is an additional cantilever foot, the secondary cantilever foot, that extends off the closed lower portion of the elongate slot 26 in the opposing direction as the primary cantilever foot. The dual cantilever design provides even more strength and rigidity once a fin is installed. In one embodiment, the dual cantilever fin box 25 could be installed along the center of the surfboard as in FIG. 15, but could potentially be used on any portion of the board that has sufficient space to allow for the second cantilever foot.

Placement and number of the fin boxes and the corresponding fins may differ depending on the type of watercraft and preference of the individual user. Fins may have one or more fin tabs which will dictate how many fin boxes are required. In the embodiment shown in FIG. 12, fin 23 has two corresponding fin tabs 36, but a fin could have one or any number of tabs depending on the size and style of the fin. When utilizing fins that have two or more tabs, the benefit of having two or more separate fin boxes is that the separation allows for more torsional and longitudinal flex in the portion of the watercraft body where the fins are installed, which is desirable to some users. Furthermore, the separation of the fin boxes creates less stiff spots in the watercraft, as well as fewer shear points created by a plurality of channel or unitary fin box designs.

Figure 15:
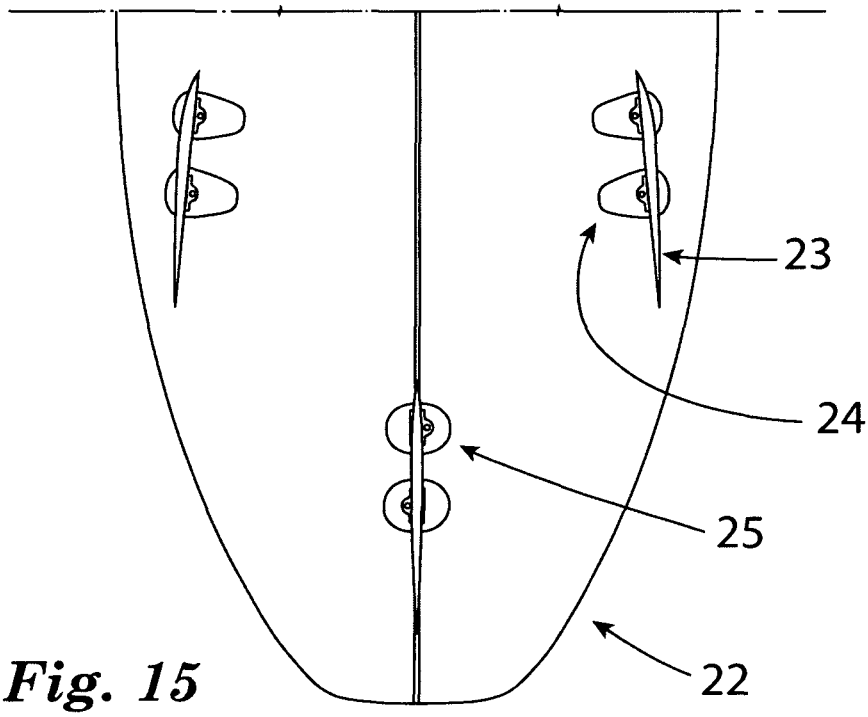
FIG. 15 is a top plan view of fins engaged in fin boxes in the rear portion of a watercraft body, in accordance with one or more implementations.
Figure 16:
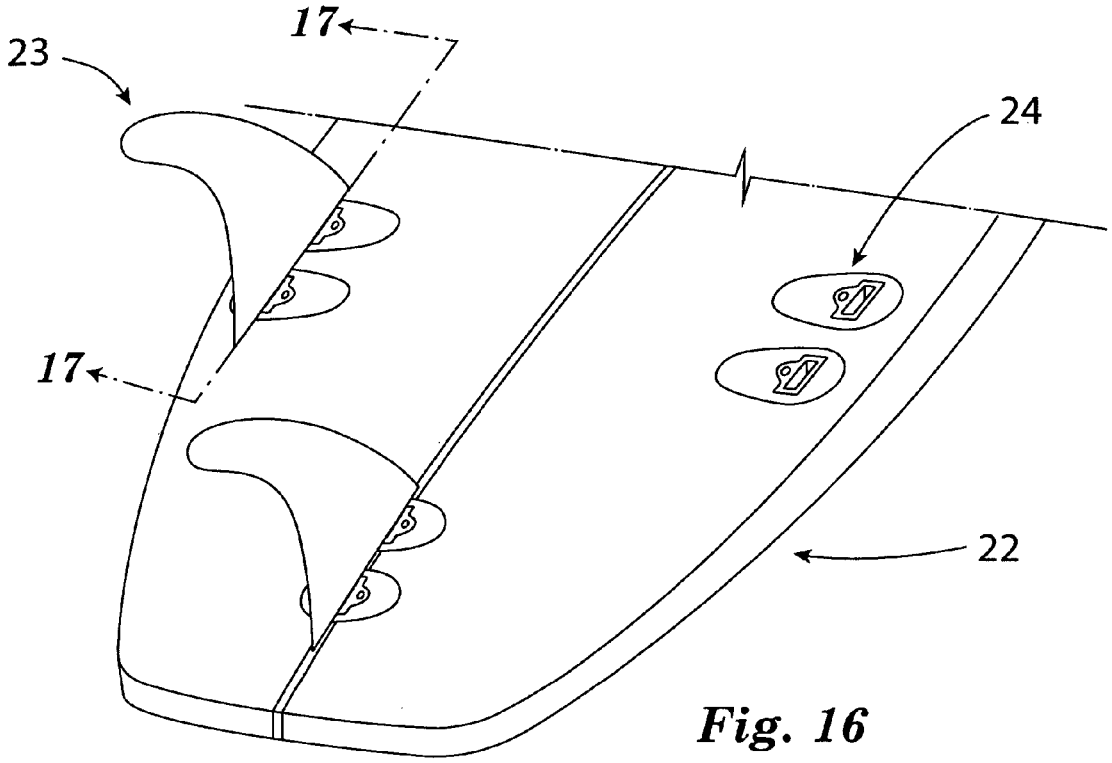
FIG. 16 is a perspective view of fins engaged in fin boxes in the rear portion of a surfboard, in accordance with one or more implementations.
Figure 17:
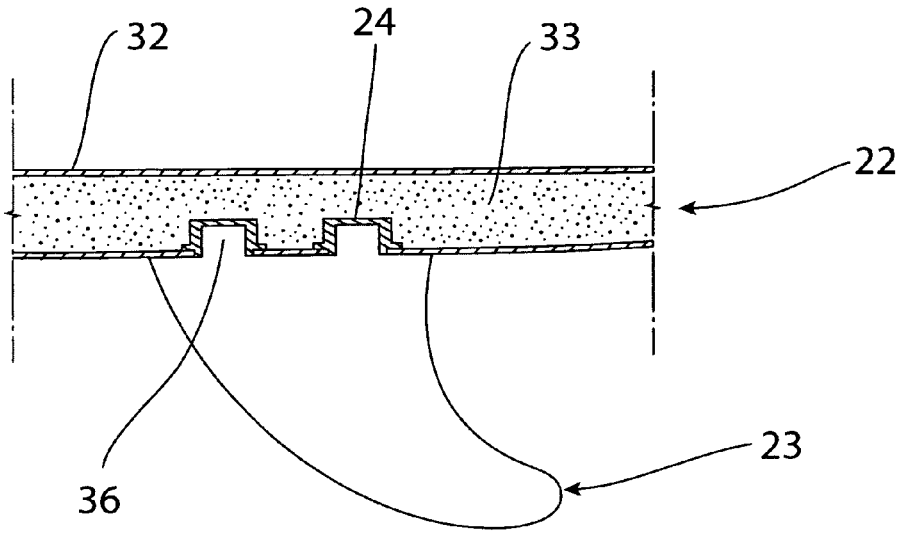
FIG. 17 is a cross-sectional view of a fin engaged in a fin box as would be seen along the line 17-17 in FIG. 16, in accordance with one or more implementations.

The embodiment shown in FIG. 15 and FIG. 16 illustrates one possible arrangement of the fin boxes and installed fins, with one fin in the rear center of the tail end of the watercraft installed into two fin boxes 25, and one fin on each side of the tail end of the watercraft installed into two fin boxes 24. Other embodiments could arrange the fin boxes and the corresponding fins in any number of patterns and locations depending on the individual user's preference and type of watercraft.

Figure 14:
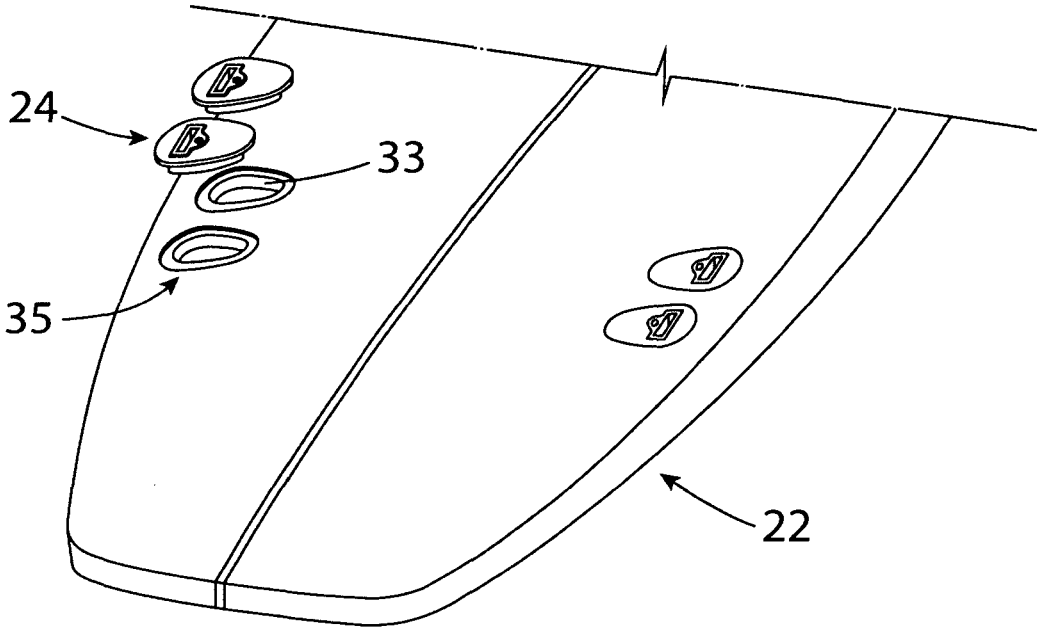
FIG. 14 is a perspective view of installation of fin boxes in the rear portion of a watercraft body, in accordance with one or more implementations.

FIG. 14 best illustrates the installation of fin boxes. In order to install fin box 24, a routed hole 35 is cut into the core material 33 of the watercraft body using a specialized jig to guide a router. After the hole is routed, a fin box is inserted and fixed into the hole using a glue or other adhesive. Once properly installed, the peripheral flange 29 will sit flush with the surface of the watercraft's core material. In most cases the core material will be foam but may be wood or other material. Once the fin boxes are set, the core material is covered by a layer of cloth made of fiber glass, carbon fiber, aramid fiber or other similar material. The cloth layer is then saturated with a resin material catalyzed with a hardener. The resin can also be hardened using ultraviolet light. Once fully cured, the resin-impregnated cloth layer becomes hard, forming the composite 32 layer of the board as seen in FIG. 6. The composite 32 provides structure to the substrate, as well as protecting the fragile core from impacts and wear from the elements.

In one embodiment, the opening of elongate slot 26 and threaded hole 27 share a raised surface that rises slightly above the surface of peripheral flange 29 as seen in FIG. 3. During the lamination process, the raised surface is temporarily covered with an adhesive tape to prevent any resin from entering the threaded hole and slot. After the lamination is cured, the taped, raised surface is sanded down exposing the openings for fin installation. The composite 32 layer covers the peripheral flange surface providing added support and strength, as well as sealing the fin box to prevent water from leaking into the core of the board.

Figure 18:
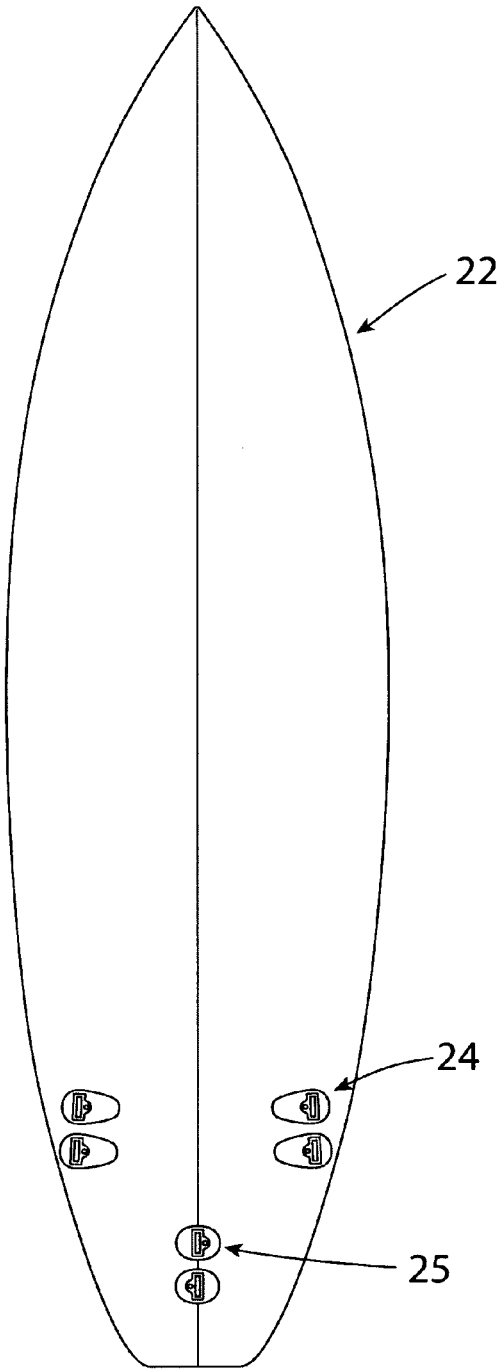
FIG. 18 is a bottom plan view of a surfboard with fin boxes installed, in accordance with one or more implementations.
Figure 19:
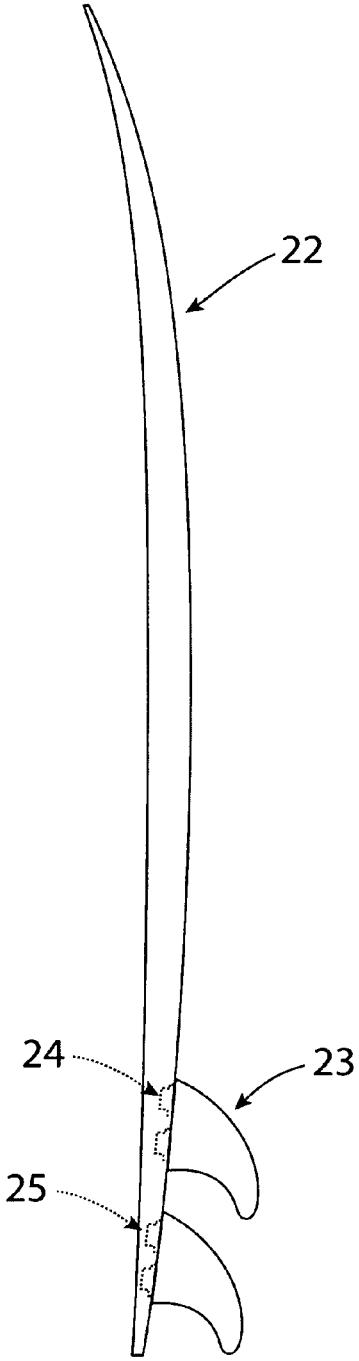
FIG. 19 is a profile view of a surfboard with fins engaged in fin boxes, in accordance with one or more implementations.

FIG. 18 and FIG. 19 illustrate one embodiment of an installed fin attachment system utilizing a three fin arrangement, each fin having two fin tabs installed into two separate fin boxes, maximizing flex of the surfboard and strength of fin attachment.

In the foregoing descriptions, numerous specific details are set forth in order to provide a thorough understanding of the present embodiments. It will be apparent, however, to one having ordinary skill in the art that the specific detail need not be employed to practice the present embodiments. In other instances, well-known materials or methods have not been described in detail in order to avoid obscuring the present embodiments.

Reference throughout this specification to "one embodiment", "an embodiment", "one example" or "an example" means that a particular feature, structure or characteristic described in connection with the embodiment or example is included in at least one embodiment of the present embodiments. Thus, appearances of the phrases "in one embodiment", "in an embodiment", "one example" or "an example" in various places throughout this specification are not necessarily all referring to the same embodiment or example. Furthermore, the particular features, structures or characteristics may be combined in any suitable combinations and/or sub-combinations in one or more embodiments or examples. In addition, it is appreciated that the figures provided herewith are for explanation purposes to persons ordinarily skilled in the art and that the drawings are not necessarily drawn to scale.

As used herein, the terms "comprises," "comprising," "includes," "including," "has," "having," or any other variation thereof, are intended to cover a non-exclusive inclusion. For example, a process, article, or apparatus that comprises a list of elements is not necessarily limited to only those elements but may include other elements not expressly listed or inherent to such process, article, or apparatus.

Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

Additionally, any examples or illustrations given herein are not to be regarded in any way as restrictions on, limits to, or express definitions of any term or terms with which they are utilized. Instead, these examples or illustrations are to be regarded as being described with respect to one particular embodiment and as being illustrative only. Those of ordinary skill in the art will appreciate that any term or terms with which these examples or illustrations are utilized will encompass other embodiments which may or may not be given therewith or elsewhere in the specification and all such embodiments are intended to be included within the scope of that term or terms. Language designating such non-limiting examples and illustrations includes, but is not limited to: "for example," "for instance," "e.g.," and "in one embodiment."

What is claimed:

1. A fin box, comprising:

an elongate slot, said elongate slot having a top open portion and a closed lower portion, said top open portion being adapted to receive a fin tab, said closed lower portion extending downward;

a peripheral flange, said peripheral flange having an upper surface and a lower surface, said upper surface extends away from said top open portion of said elongate slot and surrounds said top open portion;

a threaded hole, said threaded hole extending downward at an angle from said upper surface of said peripheral flange terminating through a lateral wall of said elongate slot; and, a primary cantilever foot, said primary cantilever foot emanating from said lower surface of said peripheral flange, having a main body that extends away in one direction from said closed lower portion of said elongate slot, wherein said main body portion has a plurality of arms of varying lengths that extend off from said main body.

2. A fin box according to claim 1, further comprising:

a secondary cantilever foot, said secondary cantilever foot emanating from said lower surface of said peripheral flange, having a secondary main body extending away from said closed lower portion of said elongate slot in an opposing direction from said primary cantilever foot, wherein said secondary main body has a plurality of arms of varying lengths that extend off from said secondary main body.

3. A fin box according to claim 1, further comprising:

a flexible side wall, said flexible side wall extending downward from said lower surface of said peripheral flange, surrounding said primary cantilever foot and said closed lower portion of said elongate slot.

4. A fin box according to claim 1, further comprising:

a secondary cantilever foot, said secondary cantilever foot emanating from said lower surface of said peripheral flange, having a secondary main body extending away from said closed lower portion of said elongate slot in an opposing direction from said primary cantilever foot, wherein said secondary main body has a plurality of arms of varying lengths that extend off from said secondary main body; and, a flexible side wall, said flexible side wall extending downward from said lower surface of said peripheral flange, surrounding said primary cantilever foot, said secondary cantilever foot, and said closed lower portion of said elongate slot.

5. A fin attachment system, comprising:

a watercraft body;

at least one fin box inserted into said watercraft body, wherein said fin box has an elongate slot, said elongate slot having a top open portion and a closed lower portion, said top open portion being adapted to receive a fin tab, said closed lower portion extending downward below a peripheral flange, said peripheral flange having an upper surface and a lower surface, said upper surface extends away from said top open portion of said elongate slot and surrounds said top open portion, wherein said upper surface contains a threaded hole extending downward at an angle from said upper surface of said peripheral flange terminating through a lateral wall of said elongate slot, and said lower surface of said peripheral flange is attached to a primary cantilever foot, wherein said primary cantilever foot has a main body that extends away in one direction from said closed lower portion of said elongate slot, and said main body portion has a plurality of arms of varying lengths that extend off from said main body;

at least one fin, said fin having a base edge with at least one fin tab protruding from said base edge for insertion into said elongate slot of said fin box; and, at least one grub screw, said grub screw being adapted for insertion into said threaded hole of said fin box, such that when tightened, said grub screw makes contact with said fin tab creating pressure and securing said fin tab in said elongate slot.

6. A fin attachment system according to claim 5, further comprising:

a secondary cantilever foot in said fin box, said secondary cantilever foot emanating from said lower surface of said peripheral flange, having a secondary main body extending away from said closed lower portion of said elongate slot in an opposing direction from said primary cantilever foot, wherein said secondary main body has a plurality of arms of varying lengths that extend off from said secondary main body.

7. A fin attachment system according to claim 5, further comprising:

a flexible side wall, said flexible side wall extending downward from said lower surface of said peripheral flange of said fin box, surrounding said primary cantilever foot and said closed lower portion of said elongate slot.

8. A fin attachment system according to claim 5, further comprising:

a secondary cantilever foot in said fin box, said secondary cantilever foot emanating from said lower surface of said peripheral flange, having a secondary main body extending away from said closed lower portion of said elongate slot in an opposing direction from said primary cantilever foot, wherein said secondary main body has a plurality of arms of varying lengths that extend off from said secondary main body; and, a flexible side wall, said flexible side wall extending downward from said lower surface of said peripheral flange of said fin box, surrounding said primary cantilever foot, said secondary cantilever foot, and said closed lower portion of said elongate slot.

* * * * *